United States Patent [19]

Stokes

[11] 4,331,121

[45] May 25, 1982

[54] BLENDING SYSTEM FOR UNCONVENTIONAL FUELS AND REGULAR FUEL OR FUELS

[76] Inventor: Charlie M. Stokes, P.O. Box 1963, Auburn, Ala. 36830

[21] Appl. No.: 141,186

[22] Filed: Apr. 17, 1980

[51] Int. Cl.[3] ..... F02D 3/02; F02D 19/06; F02M 25/08

[52] U.S. Cl. ..... 123/575; 123/1 A; 123/198 A; 123/179 G; 123/180 R; 60/39.46 P

[58] Field of Search ..... 123/575, 515, 510, 1 A, 123/198 A, 179 G, 180 R, 180 AC, 180 A; 60/39.46 P

[56] References Cited

U.S. PATENT DOCUMENTS

| | | | |
|---|---|---|---|
| 1,133,828 | 5/1915 | Adams | 123/198 A |
| 1,305,416 | 6/1919 | Taylor | 123/575 |
| 1,458,203 | 6/1923 | Tanner | 123/575 |
| 2,251,988 | 8/1941 | Curran | 123/198 A |
| 2,310,306 | 2/1943 | Miller et al. | 123/198 A |
| 2,574,321 | 11/1951 | Duncan | 123/1 A |
| 2,958,317 | 11/1960 | McNally | 123/515 |
| 3,469,954 | 9/1969 | Hoffman | 123/575 |
| 3,788,283 | 1/1974 | Perry | 123/575 |
| 3,906,915 | 9/1975 | Bednarczyk | 123/575 |
| 3,977,365 | 8/1976 | Vierling | 123/1 A |

FOREIGN PATENT DOCUMENTS

| | | | |
|---|---|---|---|
| 566968 | 9/1957 | Italy | 123/198 A |
| 54-133232 | 10/1979 | Japan | 123/1 A |

*Primary Examiner*—Wendell E. Burns
*Attorney, Agent, or Firm*—Harvey B. Jacobson

[57] ABSTRACT

A system for blending and mixing a supplemental unconventional fuel or fuels with the regular fuel or fuels utilized by a fuel consuming device, such as an internal combustion engine, furnace or other device that uses conventional petroleum fuels which enables the owner or user of the fuel consuming device to utilize supplemental fuels. The system enables the owner or user of the fuel consuming device to control or adjust the quantity of supplemental fuel that is added to the fuel system of the device and enables the owner or user to operate the device selectively with or without using the supplemental fuel mixture. In order to enable the device that is consuming the supplemental fuel or fuels, blend of supplemental fuel or fuels and regular fuel or fuels or regular fuel or fuels there is a mechanism forming part of this invention to regulate the temperature to keep the temperature of the fuels consuming device within the desired operating range for the fuels consuming device. The mechanism to control the temperature of the fuels consuming device may add heat to or remove heat from the device when in operation. Also, there may be a need to add heat to or remove heat from the fuels that are consumed by the device in order to condition the fuels so that they are in a suitable state for use in the fuel consuming device. An oxidizing or purging agent can be used to remove deposits of either fuel or expended fuels from the fuel consuming device or system that is used to condition the fuels of the fuel consuming device.

7 Claims, 3 Drawing Figures

BLENDING SYSTEM FOR UNCONVENTIONAL FUELS AND REGULAR FUEL OR FUELS

BACKGROUND OF THE INVENTION

1. Field of the Invention

This present invention generally relates to a system and mechanism for blending and mixing supplemental fuels with a conventional fuel of a device which consumes such fuel, such as an internal combustion engine with control mechanism for controlling the quantity of a supplemental fuel or supplemental fuels and the operating conditions of the device with a control responsive to such operating conditions being utilized to provide the proper fuel to the fuel consuming device.

2. Description of the Prior Art

Various efforts have been made to utilize different fuels for fuel consuming devices. Many devices are available on the market and have been patented which provide a structure for adding material to the conventional hydrocarbon fuel used in internal combustion engines of various types. The following U.S. patents are exemplary of the development in this field of endeavor.

U.S. Pat. No. 1,448,752—Mar. 20, 1923—Kopf
U.S. Pat. No. 1,485,497—Mar. 4, 1924—Emerson
U.S. Pat. No. 2,461,580—Feb. 15, 1949—Wiczer et al.
U.S. Pat. No. 2,632,637—Mar. 24, 1953—Stone
U.S. Pat. No. 3,173,408—Mar. 16, 1965—Brenneman
U.S. Pat. No. 3,223,390—Dec. 14, 1965—Bunze
U.S. Pat. No. 3,557,763—Jan. 26, 1971—Probst
U.S. Pat. No. 3,716,040—Feb. 13, 1973—Herpin
U.S. Pat. No. 3,818,876—June 25, 1974—Voogd
U.S. Pat. No. 3,991,143—Nov. 9, 1976—Carter
U.S. Pat. No. 4,056,087—Nov. 1, 1977—Boyce.
U.S. Pat. No. 4,170,960—Oct. 16, 1979—Germack et al.

SUMMARY OF THE INVENTION

An object of the present invention to provide a system which is controlled in such a manner that supplemental fuels may be added to or withheld from a fuel system of fuel consuming devices such as internal combustion engines, jet engines, furnaces, or other fuel consuming devices.

Another object of this invention is to provide a system and mechanism to add supplemental fuels to the fuel system of the fuel consuming device in the amount desired by the owner, operator, or user of the device with this system facilitating the addition of more than one supplemental fuel which may be blended together with the conventional fuel for the device with the system also having the capability of the supplemental fuels being directly blended with the conventional fuel when satisfactory or preblending the supplemental fuels before mixing them with the conventional fuel when necessary.

A further object of the present invention is to provide a system and mechanism in accordance with the preceding objects which permits the use of supplemental fuels that could not be ordinarily used by the fuel consuming device without properly blending the supplemental fuels into the regular fuel for the device thereby enabling a broader range of fuels to be consumed by the fuel consuming device.

Still another object of the invention is to provide a system in accordance with the preceding objects which permits the owner or user of the fuel consuming device to purge the device of supplemental fuels when desired thereby enabling less expensive supplemental fuels to be used in the fuel consuming device since the blend of less expensive fuel can be purged from the fuel system before the fuel consuming device is stopped, so that the less expensive fuels will not be in the fuel system of the fuel consuming device over a long period of time.

A still further object of the invention is to provide a system and mechanism in accordance with the preceding objects in which movement of the supplemental fuel or the blend of supplemental fuels or a blend of regular fuel and supplemental fuel can be obtained by the use of a pump or similar device which also facilitates blending of the fuels.

Yet another important object of the present invention is to provide a system in accordance with the preceding objects in which the mixture of supplemental and regular fuel may be accurately controlled in order to maintain the operational characteristics of the fuel consuming device in a suitable operating range.

A significant object of the present invention is to provide for the preconditioning of supplemental fuels which are not ordinarily suitable for use in the fuel consuming device in their original state with the conditioning enabling the supplemental fuels to be suitable for use by the fuel consuming device before the supplemental fuel reverts to an unusable state or condition thereby facilitating the use of fuels which are not petroleum products and reducing the consumption of petroleum products to operate fuel consuming devices.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
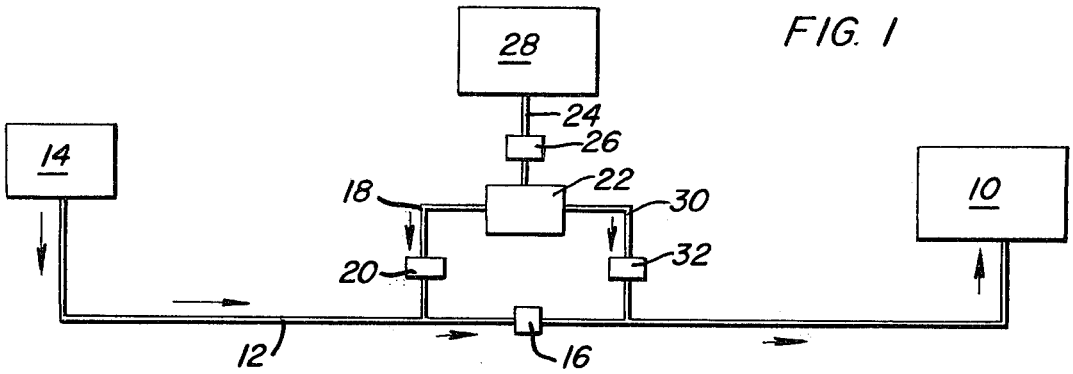
FIG. 1 is a schematic diagram of the regular fuel system of a fuel consuming device with the method and mechanism for blending or mixing supplemental fuel with the regular fuel for consumption by the fuel consuming device illustrated therein.

Referring now specifically to FIG. 1, a fuel consuming device is generally designated by the numeral 10 and may be in the form of an internal combustion engine or the like. The fuel consuming device 10 receives fuel through a fuel line 12 which is connected to a supply tank 14 which contains regular fuel for the device. For example, if the fuel consuming device 10 is an internal combustion engine, the tank 14 has a supply of gasoline, diesel fuel, or the like. While not shown, a fuel pump may be incorporated into the fuel line 12 and, of course, suitable mechanism (not shown) is utilized to introduce the fuel into the fuel consuming device. For example, on an internal combustion engine, a carburetor or fuel injection system may be employed. Thus, the fuel consuming device 10 and the tank 14 represent conventional construction.

In the present invention, a valve 16 is incorporated into the fuel line 12 so that the regular fuel may be diverted through line 18 having valve 20 therein with the fuel then entering a blender 22. The blender 22 has a supplemental fuel line 24 communicated therewith with the line 24 including a valve 26 therein and the line 24 is in communication with a tank 28 for supplemental fuel so that a supplemental fuel may be fed into the blender 22 through the line 24 and valve 26 with the valve 26 enabling the amount of supplemental fuel being fed into the blender 22 to be accurately controlled. The mixed and blended regular fuel and supplemental fuel is discharged from the blender 22 through a line 30 and a valve 32 back into the fuel line 12 and then into the fuel consuming device 10. Thus, with this system, the fuel consuming device 10 may be connected solely with the regular fuel tank 14 by opening valve 16 and closing valves 20 and 32. However, when it is desired to add the supplemental fuel and blend it with the regular fuel, the valve 16 is closed and the valves 20 and 32 opened and the valve 26 is also opened a desired amount in order to control the quantity of supplemental fuel blended with the regular fuel. Thus, not only the quantity of supplemental fuel is controlled but the addition of supplemental fuel is selective.

Figure 2:
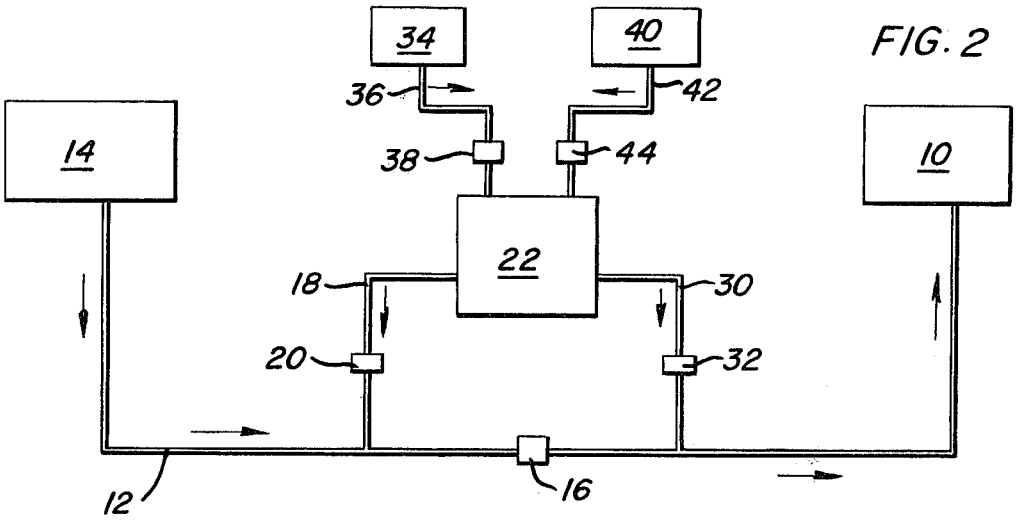
FIG. 2 is a schematic view similar to FIG. 1 but illustrating a system for blending or mixing supplemental fuel from more than one source into the regular fuel system.

FIG. 2 illustrates a system in which the regular fuel tank 14, fuel line 12, valve 16, valves 20 and 32, lines 18 and 30, blender 22 and fuel consuming device 10 are the same, except that the blender 22 is capable of blending two or more supplemental fuels selectively with the regular fuel. In this arrangement, supplemental fuel is provided in the tank 34 which communicates with the blender 22 through line 36 and a control valve 38 and a second supplemental fuel is contained in tank 40 and communicated with the blender 22 through a line 42 and a control valve 44. This arrangement provides the selection of an additional fuel mixture. For example, the fuel consuming device 10 may utilize only regular fuel from the tank 14 by opening the valve 16 and closing the valves 20 and 32. However, by closing the valve 16 and opening the valves 20 and 32, the regular fuel will be passed through the blender 22. In the blender 22, supplemental fuel from the tank 34 may be blended with the regular fuel by opening the valve 38 to a controlled setting while leaving the valve 44 closed, thus providing a mixture of regular fuel from the tank 14 and supplemental fuel from the tank 34 to the fuel consuming device 10. If it is desired to utilize two supplemental fuels, the regular fuel is mixed with the supplement fuel from the tank 34 and the supplemental fuel from the tank 40 in the blender 22 by opening both the valves 38 and 44 a controlled amount thereby providing the combination of two supplemental fuels with the regular fuel. Another possibility is the use of the regular fuel 14 and only supplemental fuel from the tank 40 which can be accomplished by opening the valve 44 and closing the valve 38. With this system, additional options are available as to utilizing only regular fuel, regular fuel blended with a controlled quantity of one supplemental fuel or the regular fuel blended with two supplemental fuels or regular fuel blended with the second of the two supplemental fuels or possibly all supplemental fuel or fuels may be utilized by the fuel consuming device after it has been operating for a predetermined period of time and reached predetermined operating temperatures.

Figure 3:
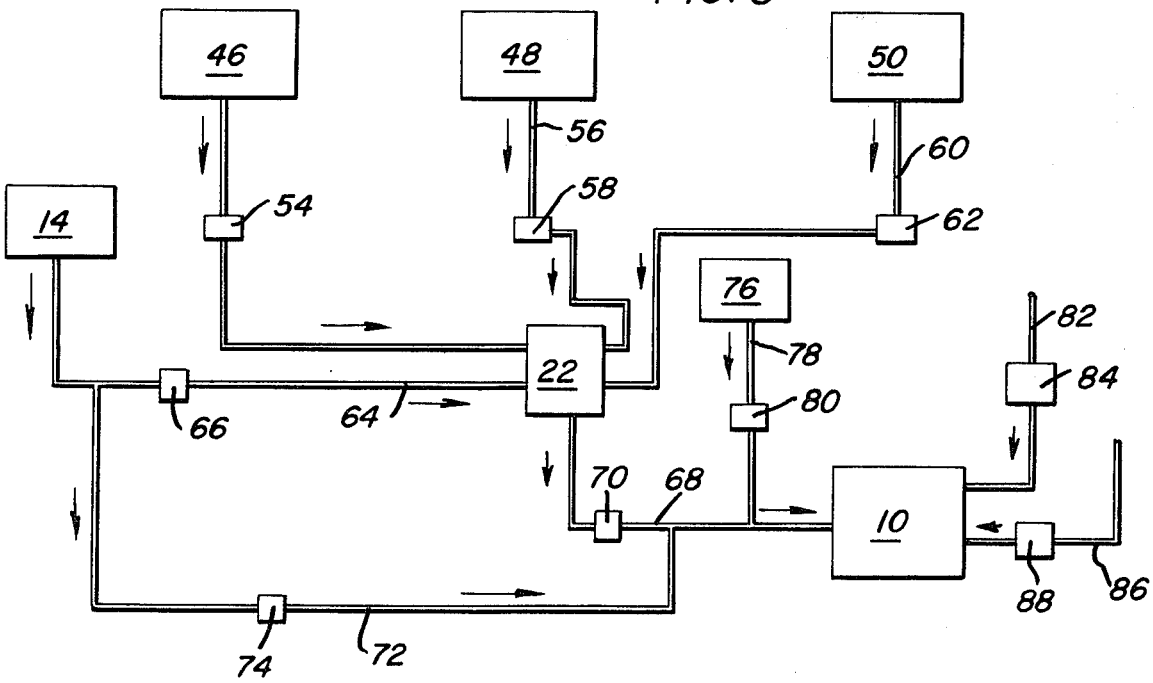
FIG. 3 illustrates diagramatically the control arrangement for regulating the supplemental fuels and regular fuel as well as the air or water, or combination thereof, that is used by a heat exchanger in controlling the temperature of the fuel consuming device which includes the supplemental fuel containers and fuel lines.

FIG. 3 illustrates a similar arrangement in which the fuel consuming device 10 includes a heat exchanger and also includes three supplemental fuel tanks 46, 48 and 50 with the tank 46 being communicated with the blender 22 through a supply line 52 and control valve 54 and the supplemental fuel tank 48 being communicated with the blender 22 through a supply line 56 and a control valve 58 and the supplemental fuel tank 50 is communicated with the blender 22 through a supply line 60 and a control valve 62. The regular fuel tank 14 is communicated with the blender 22 through a line 64 with a control valve 66 therein and the blender is communicated with the fuel consuming device 10 through a line 68 having a control valve 70 therein. A bypass regular fuel line 72 is provided from the regular fuel tank 14 to a downstream portion of the line 68, that is, between the valve 70 and the fuel consuming device 10 with a control valve 74 being provided in the line 72 so that when the valves 66 and 70 are closed and the valve 74 is opened, regular fuel only will be discharged into the line 68 and thus to the fuel consuming device 10. When the valve 74 is closed and the valves 66 and 70 opened, regular fuel will then be discharged into the blender 22 and a selected quantity of any one, any two or all three supplemental fuels from the tanks 46, 48 and 50 may be mixed and blended with the regular fuel from the tank 14 and discharged through the line 68 to the fuel consuming device 10. Also, communicating with the fuel line 68 between the valve 70 and the fuel consuming device 10 is a supply tank 76 for an oxidizing agent having a supply line 78 communicating with the fuel line 68 and provided with a control valve 80 therein for regulating the quantity of oxidizing agent introduced into the fuel consuming device. Also, the fuel consuming device has an air supply line or air supply device 82 associated therewith with a control valve 84 incorporated therein to supply a controlled quantity of air to the heat exchanger provided on the fuel consuming device. Also, a water line or water supply device 86 is provided with a control valve 88 which provides a controlled quantity of water or other liquid to the heat exchanger on the fuel consuming device 10. It is pointed out that frequently the fuel consuming device will have a heat exchanger utilizing a liquid coolant therein and a fan or other device for moving air past a radiator which forms a portion of the heat exchange system with both the liquid and air being controlled. If the fuel consuming device utilizes only air or only liquid to control the operating temperature thereof, then only a single control arrangement would be provided for the particular cooling medium used.

Frequently, supplemental fuels which are added to the regular fuel of the fuel consuming device will affect the temperature and possibly the torque output characteristics of the fuel consuming device. This temperature can be controlled or adjusted by varying the quantity of supplemental fuel added to the regular fuel of the fuel consuming device. Further, the temperature of the fuel consuming device can be controlled by varying the quantity of cooling water or air that is made available to cool the fuel consuming device. These factors can be adjusted manually by the operator of the fuel consuming device or programmable attachments can make these adjustments on the fuel consuming device. The supplemental fuel or fuels can be conditioned for use as a supplement for the regular fuel by passing them through a filter system when necessary to make them useable and sometimes it may be necessary to add heat or other materials to them in order to condition them so that they will be acceptable to the regular fuel and the fuel consuming device. With the system of the present invention, the owner or user of the fuel consuming device can selectively switch back to the regular fuel system of the device as needed to control the proper performance of the fuel consuming device.

The quantity of supplemental fuel which is added to the regular fuel is that amount that will not cause unacceptable damage to the fuel consuming device and will not provide the fuel consuming device with undesirable operating characteristics so that it will not perform the job for which it was designed. Also, if undesired deposits of material are caused by supplemental fuels and the use solely of regular fuels will not remove such deposits, an oxidizing agent or purging agent can be injected into the fuel system in an amount needed to remove such deposits from the fuel consuming device.

Also, the lowering of the operating temperature that may result when certain types of supplemental fuels are used may be offset by the blending of other supplemental fuels which can compensate for these undesirable factors such as lowering of operating temperature of the fuel consuming device.

The metering of the fuels, both regular and supplemental, can be controlled by manual controls or by programmable devices. Likewise, the temperature of the fuel consuming device can be controlled in the same manner. Any suitable structure for conditioning the supplemental fuels to make them compatible with the regular fuel and the fuel consuming device may be provided and accurately controlled manually or by programmable devices and the metering of the oxidizing agent or purging agent can be likewise controlled so that the fuel consuming device will be operated within its designed specifications without undue damage to the device when using either supplemental fuel or a combination of supplemental fuel and regular fuel.

The blending mechanism of the present invention is primarily designed to add supplemental fuels with refined fuels that are used to operate internal combustion engines, jet engines, furnaces, or similar refined petroleum fuel consuming devices. The fuels which are blended into the refined fuel system can be cheaper or more expensive than the refined fuel, but the fuel that is blended into the refined fuel system will be available and can be conditioned in a manner that will permit these fuels to be blended with the refined fuel. If the fuel consuming devices have the capacity to utilize petroleum products or fuel in a unrefined state, this blending mechanism will have the capacity to blend the refined fuel or fuels with the unrefined fuel. This invention also has the capability to enable the fuel consuming device to be purged of the supplemental and refined fuel blend to permit starting the device with only refined fuel and stopping the device with only refined fuel. During operation of the fuel consuming device with the refined and supplemental fuel, the device may be switched to only the refined fuel whenever desired by the user.

With this invention, owners or users of fuel consuming devices that are capable of using refined or a combination of refined and unrefined fuels can use the invention to incorporate the desirable or usable amounts of unrefined or supplemental fuel or fuels into the fuel system of the fuel using or consuming device. When the torque output or temperature of the fuel consuming device is not within the desired range and this desired range is affected by the supplemental or unrefined fuel or fuels, the mix or blend of the fuels may be altered until the operating characteristics are within the desired ranges. The unrefined fuel used in the present invention may include fuels obtained from biomass materials that are suitable to be converted into fuels, various organic materials that can be converted into suitable fuels, unrefined petroleum products and other products that can be converted into fuels that are suitable to be blended into refined fuels for the use in fuel consuming devices.

The present invention also permits the introduction of a controlled amount of desired materials into the fuel system of a refined fuel consuming device with the injected material being other than a supplemental fuel. With the unrefined and supplemental fuels, there may be a need to condition the material before they are suitable for use with the fuel consuming device. An example of a converted fuel is the conversion of materials to alcohol before it is used as a fuel. Many of the supplemental fuels mixed with the regular fuel of the fuel consuming device will form a suitable fuel mixture for the fuel to be utilized by the fuel consuming device. However, some of the supplemental fuels may need an agitating mechanism to form a suitable mixture of the regular fuel and the supplemental fuel or fuels to be utilized by the fuel consuming device.

Inasmuch as this invention mixes the fuels just prior to use, the regular fuel and supplemental fuel or fuels which are consumed by the device are maintained separate until they are blended just prior to introduction into the fuel consuming device, the problem of separation of the different fuels which sometimes occur when the fuel is stored is eliminated. In other words, if the regular fuel and supplemental fuel are mixed and stored, they sometimes separate into a non-homogenous mixture. By using the present invention, the problem of separation is eliminated and the capability of properly mixing and controlling the mixture of the regular fuel and supplemental fuels is facilitated.

It is known that any machine or piece of equipment which consumes fuel when it operates has built into it certain temperature ranges within which it performs most efficiently and satisfactorily. With the fuel that the fuel consuming device is designed to consume during operation, there are design features built into the device that permit the device to operate within the designed temperature range. The device is frequently kept within the desired temperature range by the use of heat exchangers that utilize either water or air or a combination of water or other liquid coolant and air to maintain the desired temperature range. The intervention of supplemental fuels into the fuel system of such a device can cause a fluctuation of the temperature during operation which can be detrimental to the operation of the device. Usually, the fuel consuming device will have a surplus of heat when using regular fuels and thus the heat exchanger is provided to remove this surplus of heat from the fuel consuming device. With the present invention, the temperature of the fuel consuming device is kept within the desired operating range of the device by blending the fuels and only when necessary, a heat exchanger is utilized to maintain the temperature within the desired operating range. If the supplemental fuel lowers the temperature of the unit when used, the amount of supplemental fuel blended with regular fuel can be adjusted to permit the device to operate within its temperature range. Alternatively, the amount of air or liquid coolant or a combination thereof can be adjusted to keep the fuel consuming device operating within the desired temperature range. A high temperature producing supplemental fuel can be used to permit the fuel consuming device to utilize other fuels than a regular fuel. If the supplemental fuel produces excessive temperature, the heat exchanger will be adjusted to keep the device operating in the desired temperature range. Thus, the desired temperature range can be maintained frequently by varying the supplemental fuels being used or by varying the quantity of such supplemental fuels or, on the other hand, the operating temperature may be controlled by the heat exchanger or both types of controls may be used for the temperature of the fuel consuming device.

Accordingly, the present invention includes several primary features, including the capability of being able to control the supplemental fuels to the extent that they can be utilized by the fuel consuming device from zero amount of supplemental fuel to maximum amounts of supplemental fuel that can be utilized by the device. During the use of supplemental fuels, the temperature can be controlled or adjusted to enable the device to make maximum use of the desired fuels. The owner or user of the device has the facilities to adjust the temperature and fuels either supplemental, regular or a combination of regular and supplemental fuels as desired. An oxidizing agent or purging agent in the amount necessary may be utilized by the user of the fuel consuming device to control any excess residue or deposits that is created in the device as a result of using the supplemental fuels or a combination of regular and supplemental fuels. It is not material whether the oxidizing agent or purging agent is injected directly into the device to assist in removing undesirable residues or injected into the fuel prior to the fuel entering the device. The supplemental fuels may be liquid, gaseous, solids, or any other materials or combinations thereof as long as the supplemental fuels are conditioned in a form that permit them to be utilized by the fuel consuming device either singly or in combination with each other or the regular fuel. Also, the owner or user of the fuel consuming device can switch from regular fuel, regular fuel and supplemental fuel in any combination that is desirable or supplemental fuel only as desired with temperature being controlled to give the performance desired with the fuel consuming device.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A system for selectively blending and mixing supplemental fuel or fuels with regular fuel for a fuel consuming device which includes a supply tank for regular fuel with a fuel line communicating directly with the fuel consuming device, a supply tank for supplemental fuel, fuel blender means, means selectively diverting regular fuel through the blender means prior to delivery to the fuel consuming device, and means selectively controlling flow or supplemental fuel to the blender means to enable a blended mixture of regular fuel and supplemental fuel to flow to the fuel consuming device and also enable only regular fuel or only supplemental fuel to flow to the fuel consuming device.

2. The system as defined in claim 1 wherein said means controlling flow of supplemental fuel or fuels to the blender means includes a flow line with valve means therein adapted to be manually controlled or controlled by a programmed control.

3. The system as defined in claim 2 wherein said means diverting regular fuel through the blender means includes a bypass line communicated with the fuel line at spaced points, a valve in said fuel line between said spaced points, said blender means being incorporated in said bypass line, and control valves in said bypass line with one of said valves being upstream of the blender means and one valve being downstream of the blender means.

4. The system as defined in claim 3 together with a second supply tank for a second supplemental fuel, a supply line having a valve therein communicating said second supply tank with said blender means to selectively enable a controlled blended mixture of regular fuel and one supplemental fuel, regular fuel and two supplemental fuels, only regular fuel, only either of the supplemental fuels or only a controlled blended mixture of two supplemental fuels to flow to the fuel consuming device.

5. The system as defined in claim 4 together with a third supply tank for a third supplemental fuel, a supply line having a valve therein communicating said third supply tank with said blender means to selectively enable a controlled blended mixture of regular fuel and any one, any two or all three supplemental fuels, only regular fuel, and only any one, any two or all three supplemental fuels to flow to the fuel consuming device.

6. The system as defined in claim 5 together with a supply tank for an oxidizing or purging agent, and a valve controlled line communicating the oxidizing or purging agent supply tank with the fuel line downstream of the blender means to enable selective removal of residue or deposits from the fuel consuming device.

7. The system as defined in claim 6 together with heat exchange means associated with the fuel consuming device, a coolant supply line communicated with the heat exchange means, a valve in said coolant supply line for controlling the operating temperature thereof in accordance with the fuel being consumed, an air supply line communicating with the heat exchange means associated with the fuel consuming device, and a valve in said air supply line to control the exchange of heat in the heat exchange means.

* * * * *